US007676190B2

(12) United States Patent
Kitamura et al.

(10) Patent No.: US 7,676,190 B2
(45) Date of Patent: Mar. 9, 2010

(54) IMAGE FORMING APPARATUS

(75) Inventors: Takatoyo Kitamura, Osaka (JP); Chisato Hatakeyama, Osaka (JP)

(73) Assignee: Kyocera Mita Corporation (JP)

( * ) Notice: Subject to any disclaimer, the term of this patent is extended or adjusted under 35 U.S.C. 154(b) by 862 days.

(21) Appl. No.: 11/388,901

(22) Filed: Mar. 24, 2006

(65) Prior Publication Data

US 2006/0222434 A1 Oct. 5, 2006

(30) Foreign Application Priority Data

Mar. 30, 2005 (JP) ..... 2005-097249

(51) Int. Cl.
*B65H 1/04* (2006.01)

(52) U.S. Cl. ..... 399/393; 400/624; 271/145; 271/171

(58) Field of Classification Search ..... 399/393
See application file for complete search history.

(56) References Cited

U.S. PATENT DOCUMENTS

2004/0257430 A1* 12/2004 Takahashi et al. ..... 347/264

FOREIGN PATENT DOCUMENTS

JP 60-137733 9/1985
JP 05270666 A * 10/1993
JP 5-330674 12/1993
JP 6-24586 2/1994
JP 6-135571 5/1994
JP 06191655 A * 7/1994
JP 6-271094 9/1994
JP 08324805 A * 12/1996
JP 2001-19172 1/2001

OTHER PUBLICATIONS

Machine translation of JP 08324805 to Asanuma from Japanese Patent Office website, Dec. 1996.*
Machine translation of JP 06191655 to Kurokawa from Japanese Patent Office website, Jul. 1994.*

* cited by examiner

*Primary Examiner*—Daniel J Colilla
(74) *Attorney, Agent, or Firm*—Gerald E. Hespos; Anthony J. Casella

(57) ABSTRACT

An image forming apparatus comprising: a paper feeding cassette which selectively stores at least two kinds of paper sheets having different size with respect to a paper feeding direction, and includes a posterior end cursor which restricts a posterior end position of the stored paper sheets with respect to the paper feeding direction, wherein the height of the posterior end cursor is changeable. According to this construction, a smaller space is provided to stack large-sized paper sheets which are not frequently used while a larger space is provided to stack small-sized paper sheets which are frequently used can be reserved.

5 Claims, 10 Drawing Sheets

IMAGE FORMING APPARATUS

BACKGROUND OF THE INVENTION

1. Field of the Invention

The present invention relates to an image forming apparatus such as a printer, a copying machine, a facsimile apparatus, a composite machine which has functions of copying, facsimile, and the like.

2. Description of the Related Art

Generally, an image forming apparatus includes a paper feeding cassette which selectively stores at least two kinds of paper sheets having different size with respect to a paper feeding direction. However, in a conventional image forming apparatus disclosed in Japanese Unexamined Patent Publication Nos. HEI 05-330674 and HEI 06-135571, for example, a cursor which restricts a posterior end of paper sheets stacked in the paper feeding cassette with respect to the paper feeding direction is held at a fixed height.

Image forming apparatuses of the prior art listed above need a paper feeding cassette which stores a large number of small-sized paper sheets since small-sized paper sheets are frequently used. Such paper feeding cassette is made to store large-sized paper sheets as well. In this case, the height of the paper feeding cassette is made to be the same as in the case of storing small-sized paper sheets. Consequently, the size of the apparatus inevitably becomes larger. However, since large-sized paper sheets are not used frequently and its number used in one time is small, the necessity of storing large-sized paper sheets as many as small-sized paper sheets is small. Further, since the total weight of the paper feeding cassette becomes larger if a maximum number of large-sized paper sheets are stacked, attaching and detaching operations of the paper feeding cassette becomes difficult.

SUMMARY OF THE INVENTION

The present invention has worked out in view of the problems described above, and its object is to provide a compact image forming apparatus which is capable of providing a space to effectively accommodate other members and has a higher operability by suppressing the space for stacking large-sized paper sheets which are not frequently used.

According to an aspect of the present invention, an image forming apparatus comprises: a paper feeding cassette which selectively stores at least two kinds of paper sheets having different sizes with respect to a paper feeding direction, and a posterior end cursor which restricts a posterior end position of the stored paper sheets with respect to the paper feeding direction. The height of the posterior end cursor is changeable.

According to the image forming apparatus of the present invention, the height of the posterior end cursor which restricts the posterior end position of the paper sheets stacked in the paper storage chamber of the feeding cassette with respect to the paper feeding direction is changeable. Consequently, depending on the situation where large-sized paper sheets are not used frequently and its number used in one time is small, a smaller space is provided to stack large-sized paper sheets which are not frequently used while a larger space is provided to stack small-sized paper sheets which are frequently used can be assured. Further, since the space for stacking large-sized paper sheets is made smaller, the total weight of the paper feeding cassette carrying paper sheets becomes smaller, so that attaching and detaching operations of the paper feeding cassette can be more easily performed. The space for stacking large-sized paper sheets which are not frequently used can be suppressed while a larger space for stacking small-sized paper sheets which are frequently used is provided, which consequently enable provision of a compact and highly operable image forming apparatus which is capable of providing a space to effectively accommodate other members.

These and other objects, features, aspects, and advantages of the present invention will become more apparent from the following detailed description of the preferred embodiments/examples with reference to the accompanying drawings.

BRIEF DESCRIPTION OF THE DRAWINGS

FIG. 5A shows a state where the posterior end cursor is positioned at an intermediate portion of the cursor rail, FIG. 5B shows a state where the posterior end cursor is positioned at the posterior end portion of the cursor rail.

FIG. 10A is an exploded perspective view of the posterior end cursor viewed from front, FIG. 10B is an exploded perspective view of the posterior end cursor viewed from back.

DETAILED DESCRIPTION OF THE PREFERRED EMBODIMENTS

Figure 1:
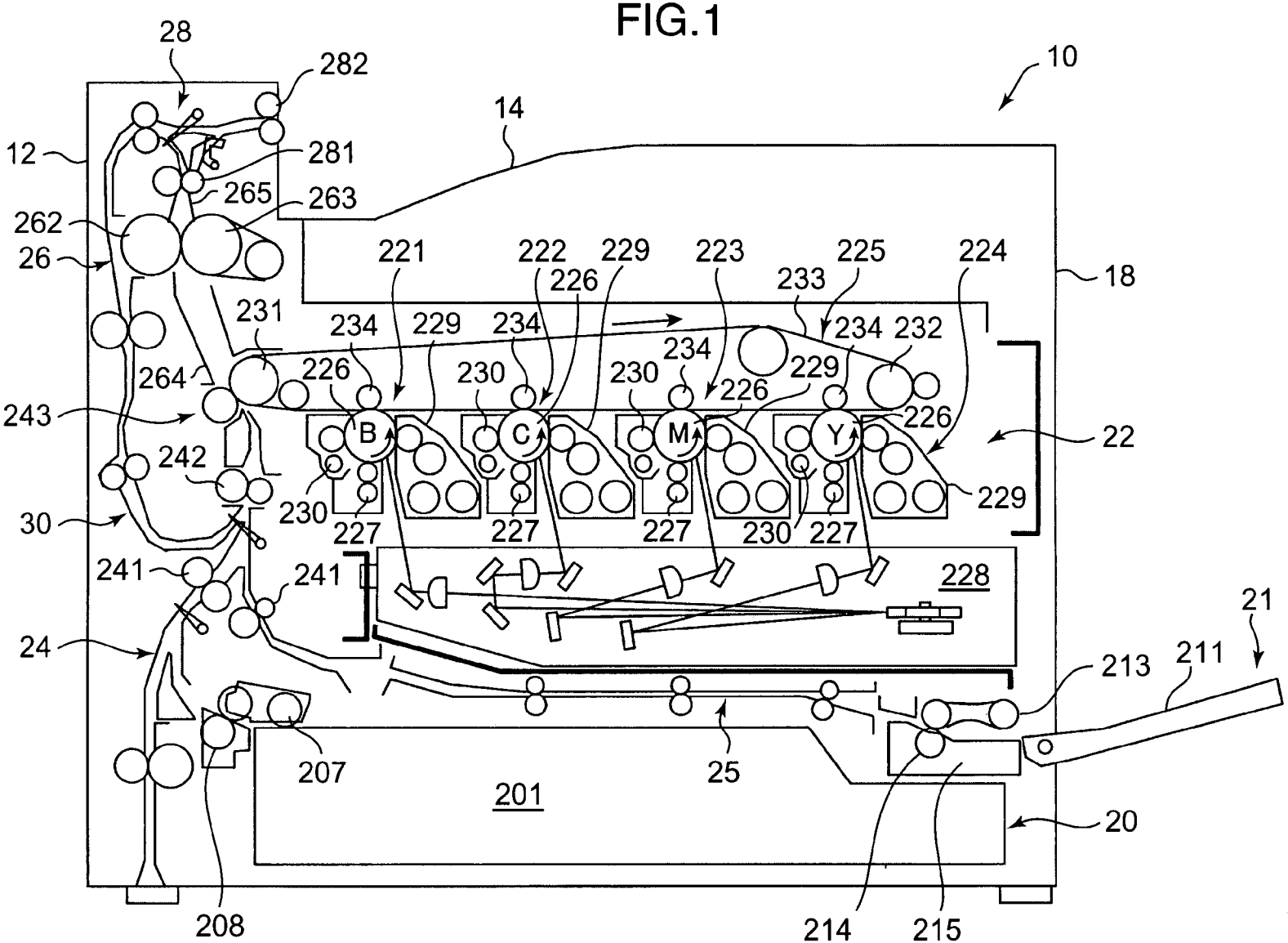
FIG. 1 is a view schematically showing an internal construction of an image forming apparatus according to an embodiment of the invention.

FIG. 1 is a diagram showing a schematic construction of an image forming apparatus according to an embodiment of the invention. An image forming apparatus 10 shown in FIG. 1 is a tandem color printer, and is constructed by a main body portion 12 and a paper sheet discharging portion 14. The main body portion 12 is adapted to form a color image on a paper sheet. The paper sheet discharging portion 14 is adapted to discharge the paper sheet on which a color image has been formed in the main body portion 12.

The main body portion 12 includes a paper feeding cassette 20, a stack tray 21, an image forming section 22, a first conveyance passage 24, a second conveyance passage 25, a fixing unit 26, and a third conveyance passage 28. The paper feeding cassette 20 is mounted in a lower part of a housing 18 and is adapted to store paper sheets. The stack tray 21 is mounted in an intermediate part of the housing 18 and is adapted to feed paper sheets for manual feeding. The image forming section 22 is provided in an upper part of the housing 18 and is adapted to form an image on a paper sheet according to image data of letters and pictures transmitted from an external device. The first conveyance passage 24 is located in a left side part of the housing 18 and is adapted to convey a paper sheet which is picked up from the paper feeding cassette 20 to the image forming section 22. The second conveyance passage 25 is located so as to extend from a right side part to the left side part of the housing 18 and is adapted to convey a paper sheet picked up from the stack tray 21 to the image forming section 22. The fixing unit 26 is provided in the left side part of the housing 18 in FIG. 1 and is adapted to execute a fixing operation to the paper sheet on which an image has been formed in the image forming section 22. The third conveyance passage 28 is adapted to convey the paper sheet on which the fixing operation has been executed to the paper discharging portion 14.

The paper cassette 20 is operable to be withdrawn outwards (frontward in FIG. 1) from the housing 18 to replenish paper sheets therein. The paper cassette 20 has a storage space for selectively storing at least two kinds of paper sheets having different sizes with respect to a paper feeding direction. The paper sheets stored in the paper storage chamber 201 are picked up and conveyed to the first conveyance passage 24 one after another by a paper feeding roller 207 and a separating roller 208.

The stack tray 21 has a paper receptacle member 211. The paper receptacle member 211 is externally provided on a right side of the housing 18 to support paper sheets for manual feeding. The paper sheets stacked on the paper receptacle member 211 are picked up and conveyed to the second conveyance passage 25 one after another by a pickup roller 213 and a separating roller 214.

The first conveyance passage 24 and the second conveyance passage 25 join together before a pair of registration rollers 242. A second transfer to a paper sheet is executed by an image carrier belt, which is to be described later on, and a second transferring roller 243, and an image transferred on the paper sheet is fixed by the fixing unit 26. According to need, the paper sheet is reversed in a fourth conveyance passage 30 to execute a second transfer on the rear surface of the paper sheet by the second transferring roller 243. After having been subjected to the fixing operation in the fixing unit 26, the paper sheet is conveyed through the third conveyance passage 28, and then is discharged by a pair of discharging rollers 282 to a paper discharge section 14. An image forming section 22 has a first image forming unit 221 which forms a black (B) toner image, a second image forming unit 222 which forms a cyan (C) toner image, a third image forming unit 223 which forms a magenta (M) toner image, a fourth image forming unit 224 which forms a yellow (Y) image and an image carrier mechanism 225 for carrying images which are formed respectively by the image forming units 221 to 224, and are to be transferred to a paper sheet.

Each of the respective image forming units 221 to 224 has a photoconductive drum 226, a charging section 227 which is provided so as to face a peripheral surface of the photoconductive drum 226, a developing section 229 which is provided so as to face the peripheral surface of the photoconductive drum 226 at a downstream of the position where the laser beam from a laser scanning unit 228 is irradiated, and a cleaning section 230 which is provided so as to face the peripheral surface of the photoconducting drum 226 at the downstream of the developing section 229. The laser scanning unit 228 irradiates a laser beam to a predetermined portion of the peripheral surface of photoconductive drum 226 at the downstream of the charging section 227.

Further, the respective photoconductive drums 226 of the image forming units 221 to 224 are rotated in a counterclockwise direction as shown in FIG. 1 by a driving motor which is not illustrated in FIG. 1. Furthermore, the respective developing sections 229 of the image forming units 221 to 224 have a toner box which stores toner particles which correspond to the predetermined toner colors of black, cyan, magenta and yellow.

The image carrier mechanism 225 has a posterior roller (driving roller) 231 which is provided near the first image forming unit 221, an anterior roller (driven roller) 232 which is provided near the fourth image forming unit 224, an image carrier belt 233 which runs around the posterior roller 231 and the anterior roller 232, and four transferring rollers 234. Each of the four transferring rollers 234 is provided so as to press the image carrier belt 233 onto the photoconductive drum 226 at a downstream of the developing section 229 in each of the respective image forming units 221 to 224.

In the image carrier mechanism 225, a paper sheet conveyed from the first conveyance passage 24 is statically attached onto the image carrier belt 233, and is conveyed to the downstream. The image carrier belt 233 is rotated in a clockwise direction as shown in FIG. 1 by the posterior roller 231 which is rotationally driven by the driving motor which is not illustrated in FIG. 1.

The first conveyance passage 24 is adapted to convey a paper sheet picked up from the paper feeding cassette 20 to the image carrier mechanism 225, and has a plurality of conveyance roller pairs 241 provided at predetermined positions and a registration roller pair 242 which are provided before the image carrier mechanism 225. The registration roller pair 242 is adapted to adjust the timing of executing an image forming operation and a paper feeding operation in the image forming section 22.

The fixing unit 26 is adapted to execute a fixing operation by heating the paper sheet on which a toner image has been transferred in the image forming section 22, and has a fixing roller 262 which is heated by an internally mounted heater, a pressing roller 263 which is mounted so as to press the fixing roller 262, an anterior conveyance passage 264 and a posterior conveyance passage 265. The anterior conveyance passage 264 is located before the fixing roller 262 and the pressing roller 263 in a heat-shielded box (unillustrated) and is adapted to guide a paper sheet conveyed by the first conveyance passage 24 to a position between the fixing roller 262 and the pressing roller 263. The posterior conveyance passage 265 is located after the fixing roller 262 and the pressing roller 263, and is adapted to guide to the third conveyance passage 28 the paper sheet which has passed through the fixing roller 262 and the pressing roller 263.

The third conveyance passage 28 is adapted to convey the paper sheet on which the fixing operation has been executed by the fixing unit 26 to the paper discharging portion 14, and has a conveyance roller pair 281 at its predetermined position and a discharging roller pair 282 at an outlet.

The paper discharging portion 14 is integrally formed with the housing and constitutes a top surface of the housing 18. The paper sheets having been subjected to the fixing operation and conveyed from the third conveyance passage 28 are sequentially stacked on the paper discharging portion 14.

Figure 2:
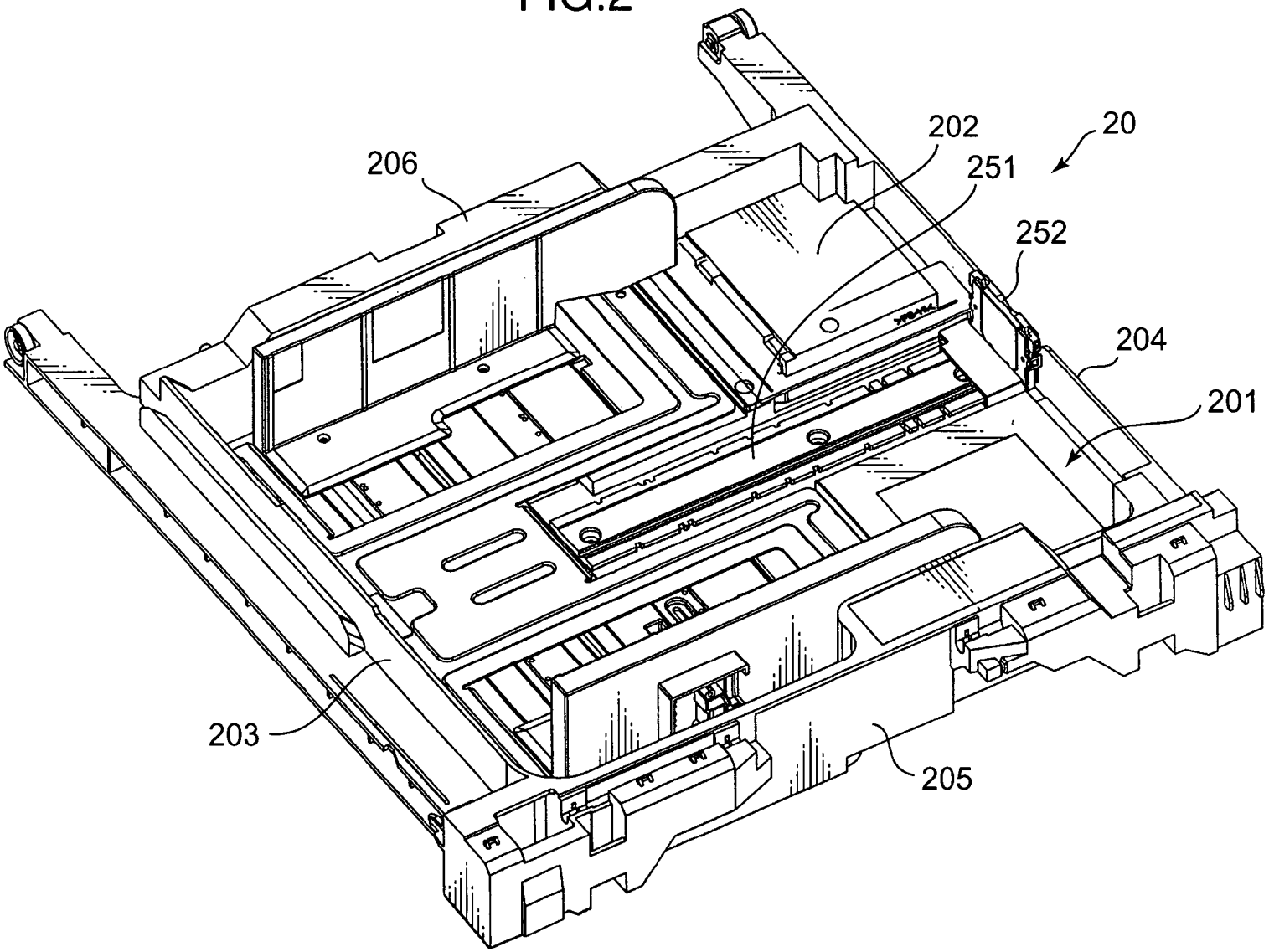
FIG. 2 is a perspective view showing an entire construction of a paper feeding cassette for use in the image forming apparatus according to the embodiment of the invention.

FIG. 2 is a perspective view showing a construction of the paper feeding cassette 20 of the image forming apparatus 10 according to the embodiment of the invention. FIGS. 3 to 6 are perspective views respectively showing a construction of a posterior end cursor 252. As shown in FIG. 2, the paper storage chamber 201 of the paper feeding cassette 20 selectively stores at least two kinds of paper sheets having different sizes with respect to a paper feeding direction, and includes a cursor rail 251 which extends in the paper feeding direction of the paper sheets stored in the paper storage chamber 201 and the posterior end cursor 252. The posterior end cursor 252 is so constructed that its height is changeable. The construction of the posterior end cursor 252 is described specifically hereinafter.

As described above, the image forming apparatus 10 comprises the stack tray 21. A support assembly 215 which supports the pickup roller 213 and the separating roller 214 for the stack tray 21 protrudes downward in the posterior end position of the paper storage chamber 201 of the paper feeding cassette 20 (refer to FIG. 1). The paper storage chamber 201 includes standing walls 203 to 206 on its rectangular bottom plate 202. Among the standing walls 203 to 206, the anterior wall 203 has a height to store a maximum number of small-sized paper sheets. The posterior wall 204 has a height to store a maximum number of large-sized paper sheets. The side walls 205 and 206 have the same height as the anterior wall 203, but has a top portion slanting down to the same height as the posterior wall 204. Herein, the anterior wall 203 is at the downstream with respect to the paper feeding direction, and the posterior wall 204 is at the upstream side with respect to the paper feeding direction. The opposite side walls 205, 206 are orthogonal to the anterior and posterior walls.

The posterior end cursor 252 is slidably mounted on the cursor rail 251 which extends in the anterior and posterior direction in the paper storage chamber 201. In the opposite sides of the cursor rail 251, a plurality of slots 251*a*, 251*b* are formed. The slots 251*a*, 251*b* are arranged in the longitudinal direction of the cursor rail 251 at predetermined intervals. The slots 251*a* and 251*b* are formed at such positions as to correspond to posterior end positions of paper sheets stored in the paper storage chamber 201. Further, slots formed in a posterior portion of the cursor rail 251 are deeper than those formed in an anterior portion of the cursor rail 251. Herein, indicated at 251*a* is small slots 251*a* having a relatively small recess and used for A4-sized paper sheets (small-sized paper sheets), and indicated at 251*b* is large slots 251*b* having a relatively large recess and used for A3-sized paper sheets (large-sized paper sheets).

Figure 6:
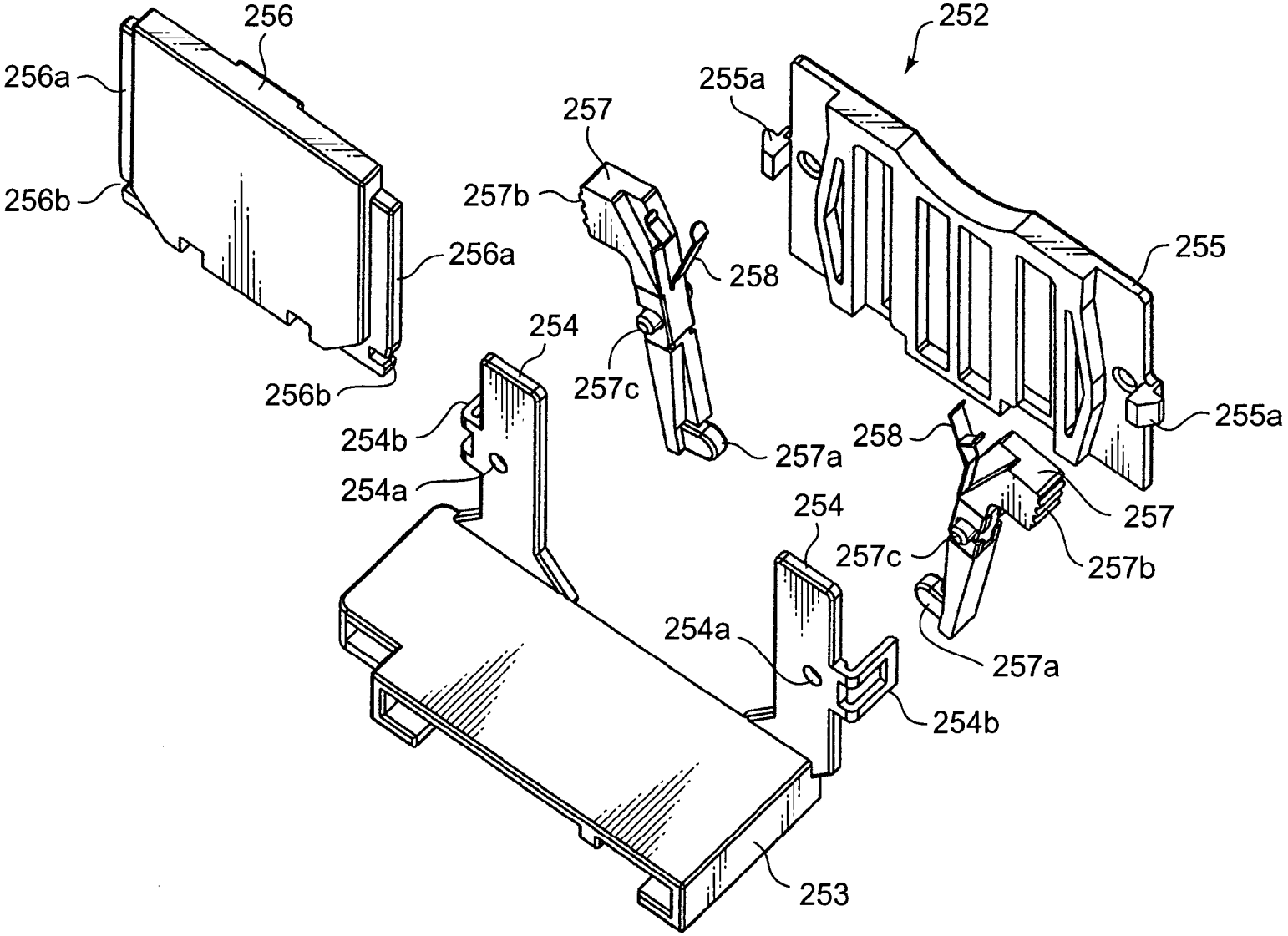
FIG. 6 is an exploded perspective view showing a construction of the changing mechanism.

As shown in FIG. 6, the posterior end cursor 252 includes a box-shaped carrier main body 253, poles 254, a plate-shaped cover member 255, a slider member 256, adjusting levers 257 and stopper springs 258. The carrier main body 253 is mounted on the cursor rail 251 slidably in the longitudinal direction, namely, in the paper feeding direction, of the cursor rail 251. The poles 254 each have circular holes 254*a* and locking portions 254*b* respectively in their middle height positions and are standingly mounted on the left and right sides of the posterior end portion of the carrier main body 253. The cover member 255 is fitted to locking portions 254*b* of the poles 254 by their fitting portions 255*a*. The slider member 256 is mounted between the poles 254 and the cover member 255 slidably in the up and down direction. The adjusting levers 257 are pivotally supported at the circle holes 254*a* of the poles 254 respectively so that holding portions 257*b* formed in their upper end portions and projecting portions 257*a* formed in their lower end portion move in the left and right direction about respective bosses 257*c*. The stopper springs 258 are mounted near the bosses 257*c* and extend in the upward direction so that they apply elastic force to a sliding portion 256*a* formed on the left and right sides of the slider member 256 and fit to slots 256*b* formed in the bottom portions of the sliding portions 256*a*. The poles 254, the slider member 256, the adjusting levers 257 and the stopper springs 258 constitute a changing mechanism.

Figure 3:
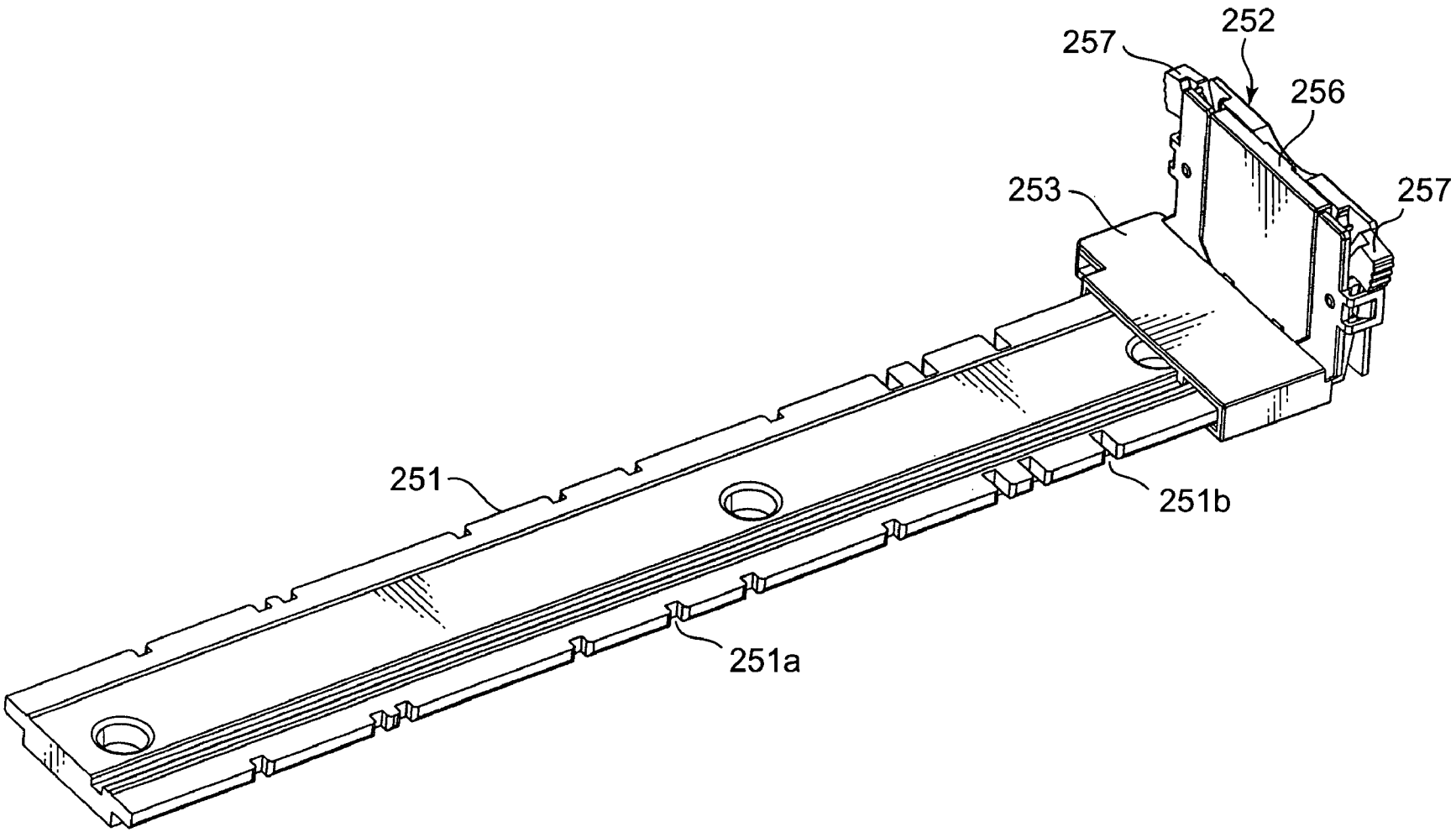
FIG. 3 is a perspective view showing a state where a posterior end cursor and a cursor rail are assembled.

The stopper springs 258 are mounted to the adjusting levers 257. The adjusting levers 257 are made pivotally supported by the respective circular holes 254*a* of the poles 254 of the carrier main body 253. The stopper springs 258 are made come in contact with left and right sides of the upper end portion of the slider member 256. The fitting portions 255*a* of the cover body 255 are fitted to the locking portions 254*b* of the poles 254. Then, the carrier main body 253 is mounted on the cursor rail 251. Consequently, the posterior end cursor 252 and the cursor rail 251 come to the state as shown in FIGS. 3 to 5.

Next, operation of the posterior end cursor 252 is described herebelow.

Figure 4:
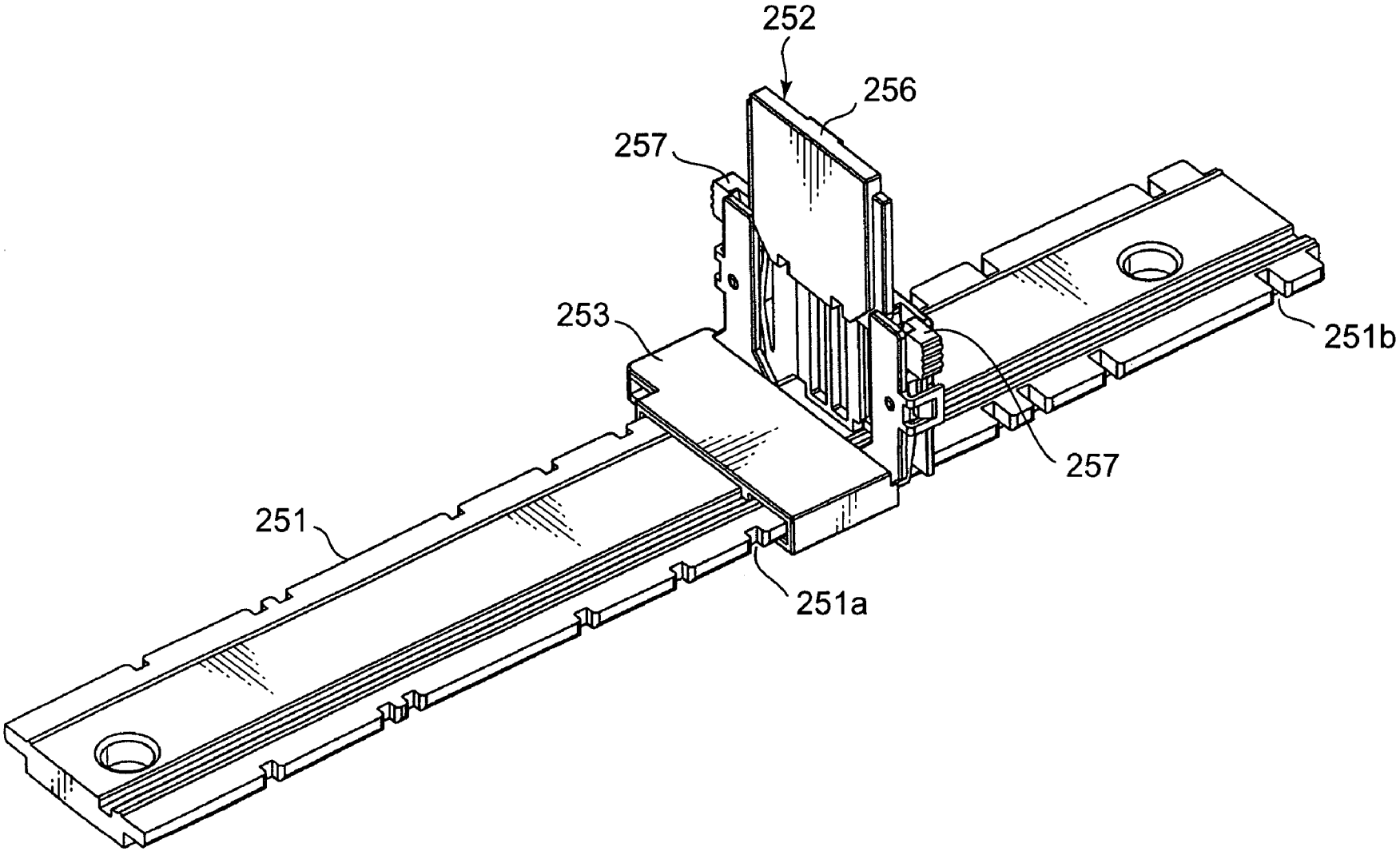
FIG. 4 is a perspective view showing another state where the posterior end cursor and the cursor rail are assembled.
Figure 5A:
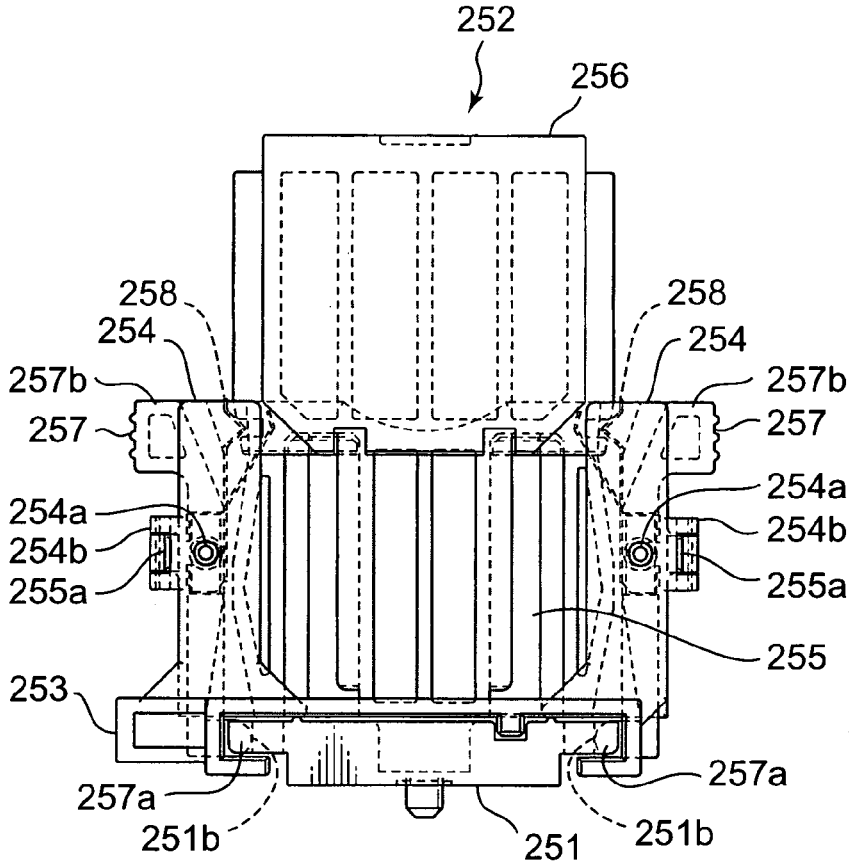
FIGS. 5A and 5B are front views showing a construction of a changing mechanism.
Figure 5B:
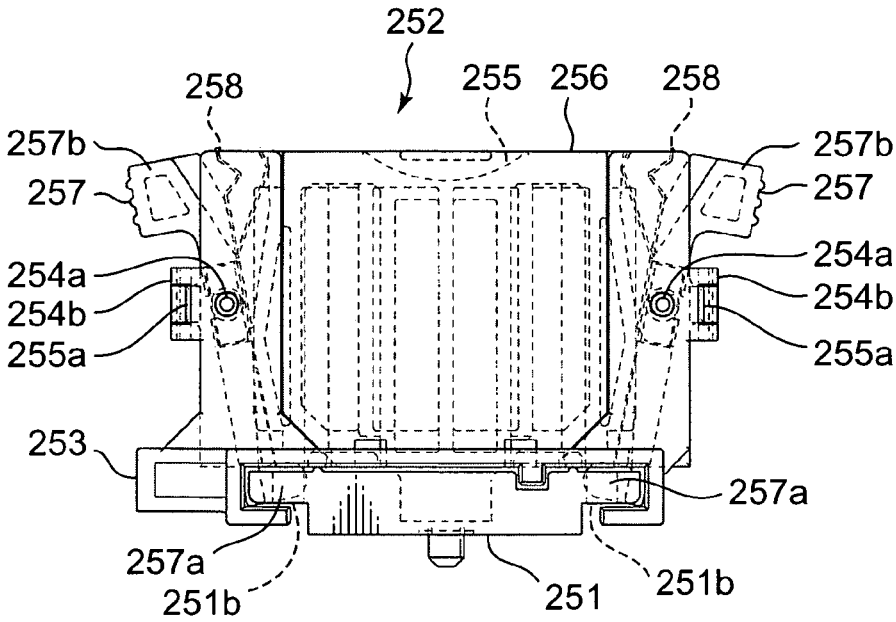

In the case where the carrier main body 253 is set at the middle position of the cursor rail 251 as shown in FIG. 4 in order to store the small-sized paper sheets in the paper storage chamber 201, if a user holds the holding portions 257*b* formed on the respective upper ends of the adjusting levers 257 which are pivotally supported at the middle position of the poles 254 on the carrier main body 253, the projecting portions 257*a* formed at the respective lower ends of the adjusting levers 257 come out from the small slots 251*a* which are formed in the cursor rail 251. Consequently, the carrier main body 253 is permitted to be moved freely on the cursor rail 251.

Then, if the user refrains from holding the holding portions 257*b* formed on the upper ends of the adjusting levers 257 when the carrier main body 253 is moved on the cursor rail 251 to the middle position, the projecting portions 257*a* formed on the lower ends of the adjusting levers 257*a* fit into the small slots 251*a* of the cursor rail 251. Consequently, the carrier main body 253 is locked on the cursor rail 251.

As can be seen, if the projecting portions 257*a* formed on the lower ends of the adjusting levers 257 are fitted into the small slots 251*a* of the cursor rail 251, the adjusting levers 257 falls in the state of being almost upstanding. In this state, the stopper springs 258 apply elastic force on the sliding portions 256*a* of the sliding members 256. Consequently, if the user pulls the slider member 256 upward, curved portions of the stopper springs 258 fit into the slots 256*b* formed in the lower portion of the sliding portion 256*a*.

Thus, the sliding member 256 does not fall down by itself by the engagement with the stopper springs 258. In this state, small-sized paper sheets can be stacked up to near the vertical position corresponding to the upper end of the slider 256 being pulled up. Even if the paper storage chamber 201 in which small-sized paper sheets are stacked is inserted into the apparatus main body, it does not interfere with the support assembly 215 which is located at the lower side of the apparatus main body.

Next, in the case where the carrier main body 253 is set at the posterior end position of the cursor rail 251 as shown in FIG. 3 in order to store large-sized paper sheets in the paper storage chamber 201, if a user holds the holding portions 257*b* formed on the upper ends of the adjusting levers 257 which are pivotally supported at the middle position of the poles 254 on the carrier main body 253, the projecting portions 257*a* formed on the lower ends of the adjusting levers 257 come out from the small slots 251*a* formed in the cursor rail 251. Consequently, the carrier main body 253 is allowed to move freely on the cursor rail 251.

If the user refrains from holding the holding portion 257*b* formed on the upper ends of the adjusting levers 257 after the carrier main body 253 is moved on the cursor rail 251 to the posterior end position, the projecting portions 257*a* formed on the lower ends of the adjusting levers 257*a* fits into the large slots 251*b* formed in the cursor rail 251. Consequently, the carrier main body 253 is locked on the cursor rail 251.

Further, the projecting portions 257*a* on the lower end portion of the adjusting levers 257 which are axially supported at the middle position of the poles 254 on the carrier main body 254 fit into the large slots 251*b* in the cursor rail 251 so that the holding portions 257*b* of the adjusting levers 257 are opened up to the opposite sides with respect to each other. Herein, the stopper springs 258 do not apply an elastic force to the sliding portions 256*a* at the opposite sides of the slider member 256. Consequently, the curved portions of the stopper springs 258 come out from the slots 256*b* formed in the lower portion of the sliding portions 256*a* of the slider member 256.

Accordingly, since the engagement of the curved portion of the stopper springs 258 with the slider member 256 is released, the slider 256 falls down itself by its own weight and overlaps the cover member 255. In this state, large-sized paper sheets can be stacked up to near the vertical position corresponding to the upper end of the slider member 256. Even if the paper storage chamber 201 in which large-sized paper sheets are stacked is inserted into the apparatus main body, it does not interfere with the support assembly 215 which is located in the lower portion of the apparatus main body.

Figure 7:
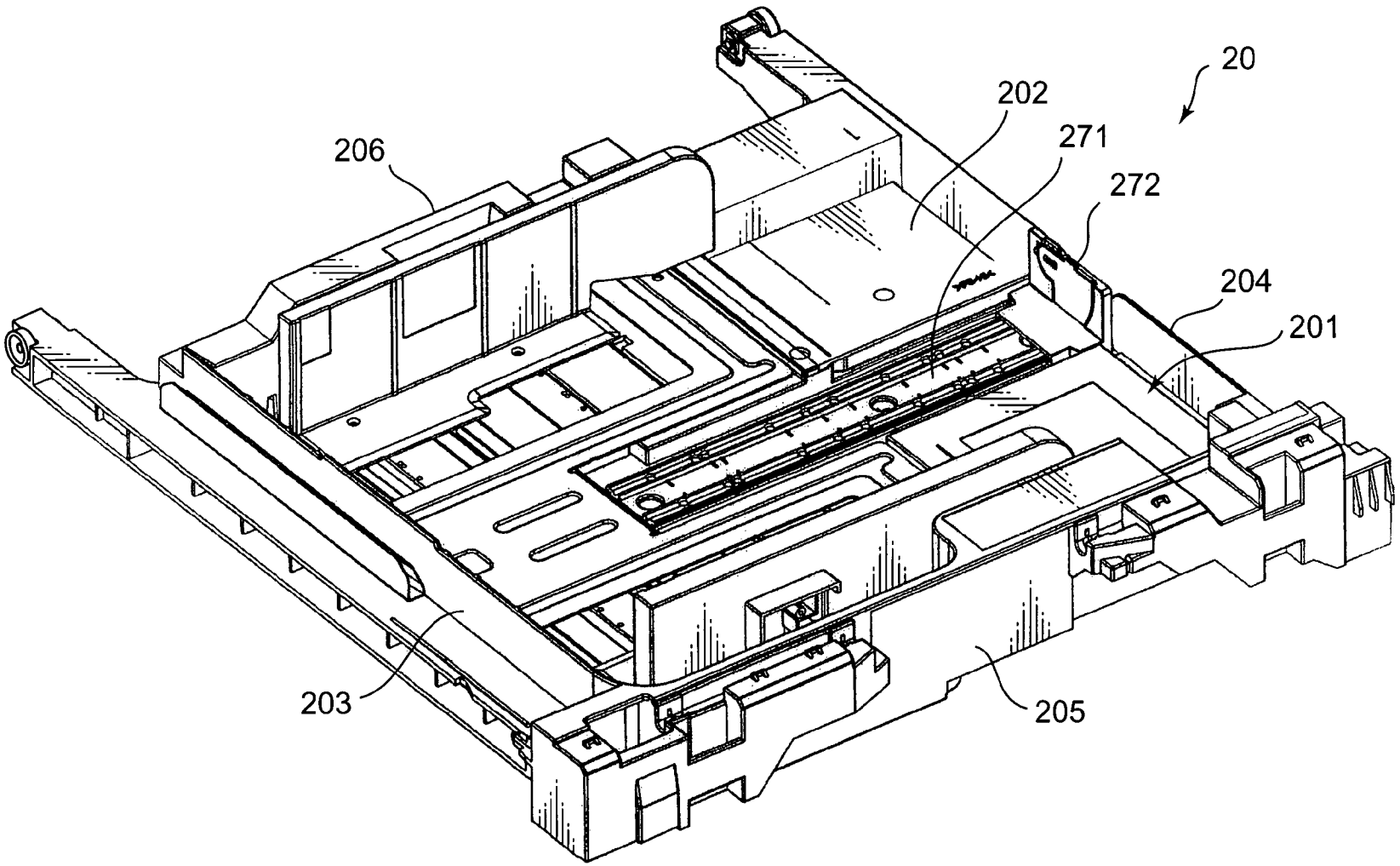
FIG. 7 is a perspective view showing an entire construction of a paper feeding cassette for use in an image forming apparatus according to another embodiment of the invention.
Figure 8:
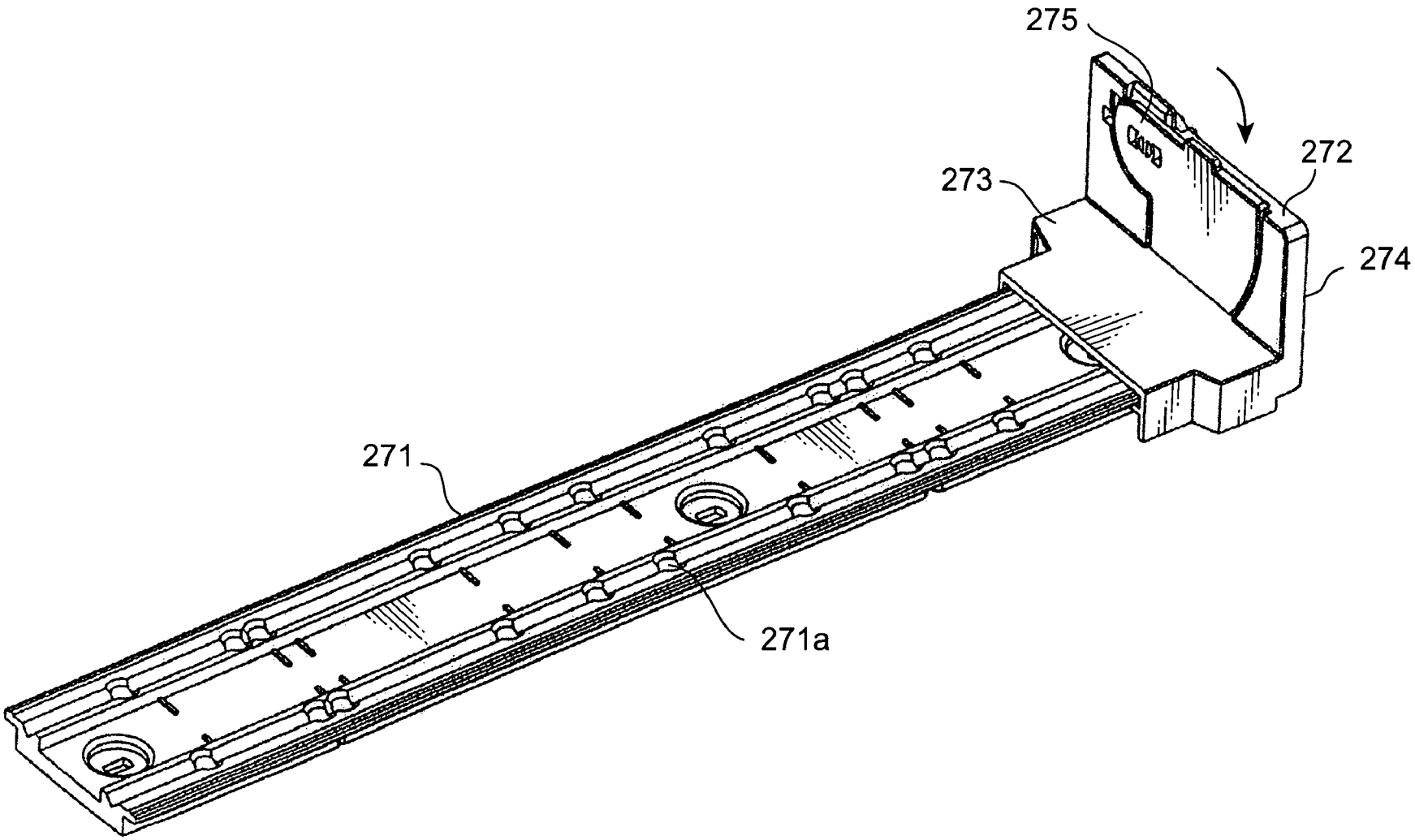
FIG. 8 is a perspective view showing a state where a posterior end cursor and a cursor rail according to another embodiment of the invention are assembled.
Figure 9:
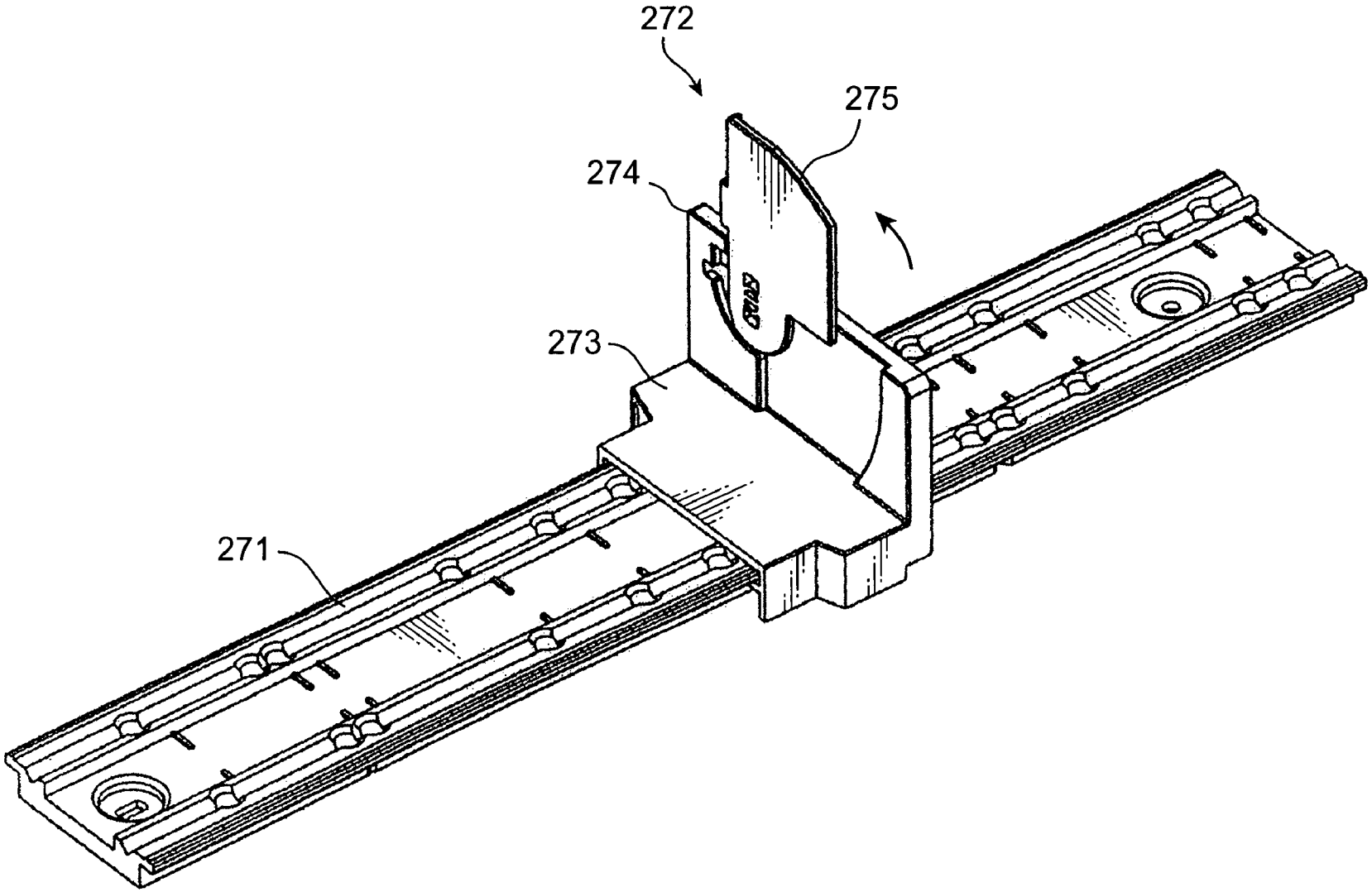
FIG. 9 is a perspective view showing another state of where the posterior end cursor and the cursor rail according to another embodiment of the invention are assembled.

According to the construction above, the height of the posterior end cursor 252 which restricts the posterior end position of the paper sheets stacked in the paper storage chamber 201 of the paper feeding cassette 20 with respect to the paper feeding direction is changeable. Consequently, depending on the situation where large-sized paper sheets are not used frequently and its number used in one time is small, a smaller space is provided to stack large-sized paper sheets which are not frequently used while a larger space is provided to stack small-sized paper sheets which are frequently used can be reserved. Further, since the space for stacking large-sized paper sheets is made smaller, the total weight of the paper feeding cassette 20 carrying paper sheets becomes smaller, so that attaching and detaching operations of the paper feeding cassette 20 are made easily. Furthermore, since the lowering of the height of the posterior end cursor 252 is not done by the user, breakage of the posterior end cursor 252 and excess stacking of the paper sheets can be securely prevented even if a member which physically restricts the height of the paper feeding cassette 20, such as the support assembly 215 exists. Thus, the space for stacking large-sized paper sheets which are not used frequently can be suppressed even if the larger space for stacking small-sized paper sheets which are frequently used is reserved. This enables a compact image forming apparatus which is capable of providing a space to effectively accommodate other members, and has a higher operability. An internal construction of an image forming apparatus according to another embodiment of the invention is identical to that of the first embodiment described above. Therefore, description of the image forming apparatus is omitted. FIG. 7 is a perspective view showing a construction of a paper feeding cassette 20 for use in the image forming apparatus 10 according to the another embodiment of the invention. FIGS. 8 to 10 are perspective views respectively showing a construction of a posterior end cursor 272. As shown in FIG. 7, the paper feeding cassette 20 includes a paper storage chamber 201 which selectively stores at least two kinds of paper sheets having different sizes with respect to a paper feeding direction, a cursor rail 271 which extends in the paper feeding direction of the paper sheets stored in the paper storage chamber 201, and the posterior end cursor 272 which is slidably supported on the cursor rail 271. The posterior end cursor 272 is so constructed that its height is changeable. The construction of the posterior end cursor 272 is described specifically hereinafter.

As described above, the image forming apparatus 10 comprises the stack tray 21. The support 215 which supports the pickup roller 213 and the separating roller 214 for the stack tray 21 protrudes downward in the posterior end position of the paper storage chamber 201 of the paper feeding cassette 20. As shown in FIG. 7, the paper storage chamber 201 is defined by standing walls 203 to 206 and a rectangular bottom plate 202. Among the standing walls 203 to 206, the anterior wall 203 has a height to store maximum number of small-sized paper sheets. The posterior wall 204 has a height to store a maximum number of large-sized paper sheets. The side walls 205 and 206 have the same height as the anterior wall 203, but have a top portion slanting down to the same height as the posterior wall 204. Herein, the anterior wall is at the downstream with respect to the paper feeding direction, and the posterior wall 204 is at the upstream side with respect to the paper feeding direction. The opposite side walls 205, 206 are orthogonal to the anterior and posterior walls.

The posterior end cursor 272 is slidably mounted on the cursor rail 271 which extends in the anterior and posterior direction in the paper storage chamber 201. In the upper surface of the cursor rail 271, a plurality of slots 271*a* are formed. The slots 251 are arranged in the longitudinal direction of the cursor rail 251 at predetermined intervals. The slots 271*a* are circular slots formed at such positions as to correspond to posterior end positions of the paper sheets stored in the paper storage chamber 201.

Figure 10A:
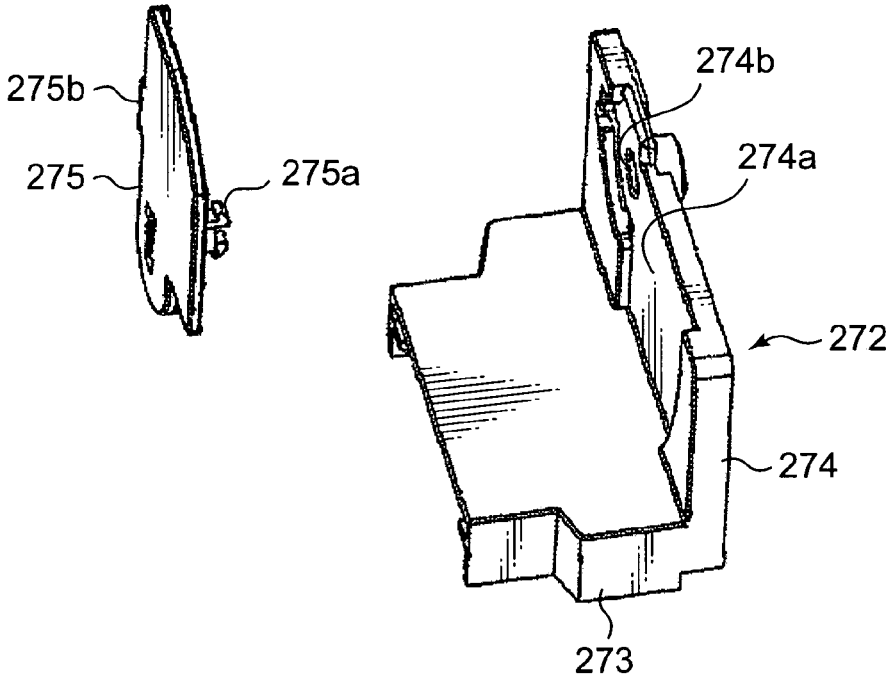
FIGS. 10A and 10B are views showing a construction of the posterior end cursor according to another embodiment of the invention.
Figure 10B:
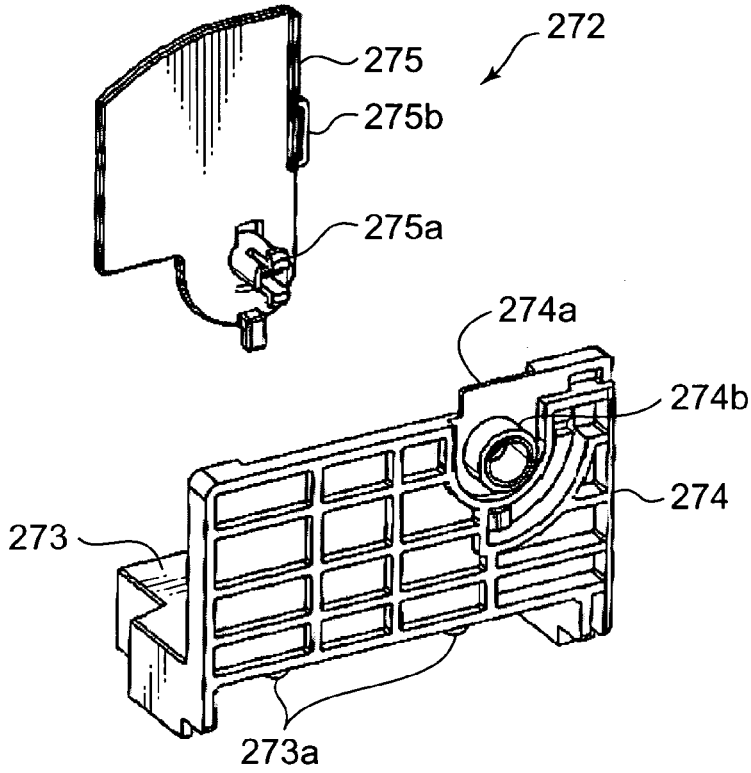

As shown in FIGS. 10A and 10B, the posterior end cursor 272 includes a box-shaped carrier main body 273, a standing wall 274 and a plate-shaped rotatable member (shiftable member) 275. The carrier main body 273 is mounted on the cursor rail 271 slidably in the longitudinal direction of the cursor rail 271. The standing wall 274 is mounted on the posterior portion of the carrier main body 273. At the approximately intermediate portion with respect to a width direction of the standing wall 274, a recess 274*a* and a hollow boss 274*b* are formed. The rotatable member 275 is guided by the recess 274*a* and is rotatably fitted to the hollow boss 274*b* by a fitting shaft 275*a*.

While the rotatable member 275 is in the recess 274*a* of the standing wall 274 of the carrier main body 273, the fitting shaft 275 of the rotatable member 275 is inserted into the hollow boss 274*b* of the standing wall 274. Thereafter, the carrier main body is mounted on the cursor rail 271. Consequently, the posterior end cursor 272 and the cursor rail 271 come to the state as shown in FIGS. 8 and 9.

Next, the operation of the posterior end cursor 272 is described herebelow.

In the case where the carrier main body 273 is set at the middle position of the cursor rail 271 as shown in FIG. 9 in order to store small-sized paper sheets in paper storage chamber 201, when a user holds and pulls up the carrier main body 273, projecting portions 273*a* formed on the lower end of the carrier end body 273 come out from slots 271*a*. Consequently, the carrier main body 273 is permitted to be moved freely on the cursor rail 271.

Then, if the user refrains from holding the carrier main body 273 when the carrier main body 273 is moved on the cursor rail 271 to a middle position, the projecting portions 273*a* formed on the lower end of the carrier main body 273 fit into another slots 271*a* of the cursor rail 271. Consequently, the carrier main body 273 is locked on the cursor rail 271. At this time, if the user rotates the rotatable member 275 about the fitting shaft 275*a* in a counter-clockwise direction (direction of the arrow in FIG. 9), the rotatable member 275 is shifted to the projection position on the upper end of the standing wall 274. In the state of being in the projection position, the rotatable member 275 tilts toward one side.

A projecting portion 275*b* is formed on the rotatable member 275. In the state where the rotatable member 275 is in the projection position, the projecting portion 275*b* comes in contact with the upper end portion of the standing wall 274 so that it restricts the rotation of the rotatable member, thereby small-sized paper sheets can be stored up to the upper end of the projecting rotatable member 275. Even if the paper storage chamber 201 in which small-sized paper sheets are stacked is inserted into the apparatus main body, it does not interfere with the support assembly 215 which is located in a lower portion of the apparatus main body.

Next, in the case where the carrier main body 273 is set at the posterior end position of the cursor rail 271 as shown in FIG. 8 in order to store large-sized paper sheets in the paper storage chamber 201, when a user holds and pulls up the carrier main body 273, the projecting portions 273*a* formed on the lower end of the carrier main body 273 come out from slots 271*a* formed in the cursor rail 271. Consequently, the carrier main body 273 is allowed to move freely on the cursor rail 271.

If the user refrains from holding the carrier main body 273 after the carrier main body 273 is moved on the cursor rail 271 to the posterior end position, the projecting portions 273*a* formed on the lower end of the carrier main body 273 fits into the slots 271*a*. Consequently, the carrier main body 273 is locked on the cursor rail 271.

At this time, if the user holds and rotates the rotatable member 275 about the fitting shaft 275*a* in a clockwise direction (direction of the arrow in FIG. 8), the rotatable member 275 is shifted to a retreat position where the rotatable member 275 does not project upward from the standing wall 274.

Then, the lower end of the rotatable member 275 comes in contact with the upper end portion of the carrier main body 273 so that it restricts the rotation of the rotatable member 275. In this state, the rotatable member is flush with the standing wall 274, and large-sized paper sheets can be stored up to near the upper end of the rotatable member 275. Even if the paper storage chamber 201 in which large-sized paper sheets are stacked is inserted into the apparatus main body, it does not interfere with the support assembly 215 (FIG. 1) which is located in the lower portion of the apparatus main body.

On the other hand, in the case where the user forgets to rotate the rotatable member 275 and the rotatable member 275 is left in the projecting position where the rotatable member 275 projects upward from the standing wall 274, the rotatable member 275 interferes with the support assembly 215 when the storage chamber 201 is inserted into the apparatus main body. The support assembly 215 comes in contact with the part of the rotatable member 275 being in the projection position that the projecting portion 275*b* is formed, and causes the rotatable member 275 to rotate in the clockwise direction (direction of the arrow in FIG. 8). Consequently, in such a state, the rotatable member 275 is shifted to the retreat position and it does not interfere with the support assembly 215 which is located in the lower portion of the apparatus main body.

According to the construction above, the height of the posterior end cursor 272 which restricts the posterior end position of the paper sheets stacked in the paper storage chamber 201 of the feeding cassette 20 with respect to the paper feeding direction is changeable. Consequently, depending on the situation where large-sized paper sheets are not used frequently and the number used in one time is small, a smaller space is provided to stack large-sized paper sheets which are not frequently used while a larger space is provided to stack small-sized paper sheets which are frequently used can be ensured. Further, since the space for stacking large-sized paper sheets is made smaller, the total weight of the paper feeding cassette 20 carrying paper sheets becomes smaller, so that attaching and detaching operations of the paper feeding cassette 20 can be made easily. Furthermore, the shifting of the posterior end cursor 272 to the retreat position does not depend on the user's operation. Accordingly, breakage of the posterior end cursor 272 and excess stacking of the paper sheets can be securely prevented even if the paper feeding cassette is inserted into a space having a member which physically restricts the movement of the paper feeding cassette 20, such as the support assembly 215.

In the embodiments described above, a tandem color printer is used as an example of the image forming apparatus 10. However, it goes without saying that the present invention can be applied to other kinds of image forming apparatuses.

As described above, an image forming apparatus comprises: a paper feeding cassette which selectively stores at least two kinds of paper sheets having different sizes with respect to a paper feeding direction, and a posterior end cursor which restricts a posterior end position of the stored paper sheets with respect to the paper feeding direction. The height of the posterior end cursor is changeable.

According to the image forming apparatus, the height of the posterior end cursor which restricts the posterior end position of the paper sheets stacked in the paper storage chamber of the feeding cassette with respect to the paper feeding direction is changeable. Consequently, depending on the situation where large-sized paper sheets are not used frequently and the number used in one time is small, a smaller space is provided to stack large-sized paper sheets which are not frequently used while a larger space is provided to stack small-sized paper sheets which are frequently used can be reserved. Further, since the space for stacking large-sized paper sheets is made smaller, the total weight of the paper feeding cassette carrying paper sheets becomes smaller, so that attaching and detaching operations of the paper feeding cassette can be made easily. Thus, since the space for stacking large-sized paper sheets which are not frequently used can be suppressed while a larger space for stacking small-sized paper sheets which are frequently used is provided, a compact and highly operable image forming apparatus which is capable of providing a space to effectively accommodate other members can be provided.

Meanwhile, in an image forming apparatus where a maximum number of paper sheets to be stacked depends on sizes of paper sheets due to an existence of a member which physically restricts movement of a paper feeding cassette, it is required to shift the posterior end cursor to a retreat position to prevent breakage of the posterior end cursor and excess stacking of paper sheets. However, if the height changing depends on the user's operation, breakage of parts, malfunctioning of paper feeding due to excess stacking of paper sheets and such are likely to occur. In this regard, it is preferable that the paper feeding cassette includes a cursor rail which supports the posterior end cursor slidably in the paper feeding direction and that the posterior end cursor includes a changing mechanism for changing the vertical position of the upper end of the posterior end cursor according to a supporting position of the posterior end cursor on the cursor rail.

According to this construction, since the paper feeding cassette includes the cursor rail which supports the posterior end cursor slidably in the paper feeding direction and the changing mechanism for changing the vertical position of the upper end of the posterior end cursor according to a supporting position of the posterior end cursor on the cursor rail is provided, the dependence of height changing of the posterior end cursor on the user's operation can be eliminated. Consequently, breakage of the posterior end cursor and excess stacking of the paper sheets can be effectively prevented.

Further, it is preferable that the cursor rail includes a plurality of slots having different sizes along the cursor sliding direction and that the changing mechanism changes the vertical position of the upper end of the posterior end cursor according to a size of a slot formed in the cursor rail.

According to this construction, since the cursor rail includes a plurality of slots having different sizes along the cursor sliding direction and the vertical position of the upper end of the posterior end cursor is changed according to a size of a slot formed in the cursor rail, the dependence of height changing of the posterior end cursor on the user's operation can be eliminated. Consequently, breakage of the posterior end cursor and excess stacking of the paper sheets can be effectively prevented.

Further, it is preferable that the posterior end cursor includes a carrier main body supported on the cursor rail and that the changing mechanism includes a slider member supported on the carrier main body slidably in a vertical direction and a moving actuator for moving the slider member up and down with respect to the carrier main body in accordance with a size of a slot at a supporting position of the posterior end cursor.

According to this construction, since the posterior end cursor includes a carrier main body supported on the cursor rail and that the changing mechanism includes a slider member supported on the carrier main body slidably in a vertical direction and a moving actuator for moving the slider member up and down with respect to the carrier main body in accordance with a size of a slot at a supporting position of the posterior end cursor, the dependence of height changing of the posterior end cursor on the user's operation can be eliminated. Consequently, breakage of the posterior end cursor and excess stacking of the paper sheets can be effectively prevented.

Further, it is preferable that the posterior end cursor includes a shiftable member shiftable to a projection position and a retreat position and vise versa, and that the shiftable member is operable to shift to the retreat position when the paper feeding cassette is inserted in the state of the shiftable member being in the projection position and the shiftable member then comes into contact with a part of a main body of the image forming apparatus.

According to this construction, since the shiftable member of the posterior end cursor come into contact with a support assembly which constitutes a part of the image forming apparatus to be shifted to the retreat position if the paper feeding cassette is inserted into the main body of the image forming apparatus in the state where the posterior end cursor is positioned at the upstream of the paper feeding direction of the paper feeding cassette, the dependence of height changing of the posterior end cursor on the user's operation can be eliminated. Consequently, breakage of the posterior end cursor and excess stacking of the paper sheets can be effectively prevented.

This application is based on patent application No. 2005-97249 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a paper feeding cassette which selectively stores at least two kinds of paper sheets having different size with respect to a paper feeding direction, and includes:

a posterior end cursor which restricts a posterior end position of the stored paper sheets with respect to the paper feeding direction, the height of the posterior end cursor being changeable, a cursor rail that supports the posterior end cursor slidably at each of a plurality of supporting positions in a paper feeding direction, the cursor rail including a plurality of slots having different sizes along the sliding direction of the posterior end cursor, and a changing mechanism that allows a position of an upper end portion of the posterior end cursor to be changed vertically in accordance with the size of the slot at the respective supporting position of the posterior end cursor on the cursor rail.

2. An image forming apparatus according to claim 1, wherein the posterior end cursor includes a carrier main body supported on the cursor rail, and the changing mechanism includes a slider member supported on the carrier main body slidably in a vertical direction, and a moving actuator for moving the slider member up and down with respect to the carrier main body in accordance with the size of the slot at the respective supporting position of the posterior end cursor.

3. An image forming apparatus according to claim 1, wherein the cursor rail has opposite anterior and posterior ends, the slots in proximity to the anterior end having a first of the different sizes and the slots in proximity to the posterior end having a second of the different sizes.

4. An image forming apparatus according to claim 3, wherein the slots in proximity to the anterior end are smaller than the slots in proximity to the posterior end.

5. An image forming apparatus, comprising:

a paper feeding cassette which selectively stores at least two kinds of paper sheets having different sizes with respect to a paper feeding direction, the paper feeding cassette including:

a posterior end cursor that restricts a posterior end position of the stored paper sheets with respect to the paper feeding direction, the height of the posterior end cursor being changeable, a cursor rail that supports the posterior end cursor slidably in the paper feeding direction, a shiftable member attached to the posterior end cursor and being shiftable between a projection position and a retreat position, and an apparatus main body on which the paper feeding cassette is mounted, the apparatus main body including an assembly capable of interfering with the shiftable member, wherein the shiftable member interferes with the assembly so that the orientation of the shiftable member is changed toward the retreat position when the paper feeding cassette is inserted in the apparatus main body with the posterior end cursor being in a first position on the cursor rail and in the projection position, the shiftable member stays in the projection position without interfering with the assembly when the paper feeding cassette is inserted in the apparatus main body with the posterior end cursor being in a second position on the cursor rail that is different from the first position and in the projection position.

* * * * *